US005433653A

United States Patent [19]

Friess

[11] Patent Number: 5,433,653

[45] Date of Patent: Jul. 18, 1995

[54] BLASTING APPARATUS, COMPONENTS THEREOF AND RELATED METHODS FOR USE THEREOF

[75] Inventor: James C. Friess, Akron, Ohio

[73] Assignee: Friess Equipment, Inc., Akron, Ohio

[21] Appl. No.: 142,951

[22] Filed: Oct. 29, 1993

[51] Int. Cl.[6] ..... B24C 7/00

[52] U.S. Cl. ..... 451/38; 451/60; 451/99; 451/100; 451/101

[58] Field of Search ..... 451/38, 39, 40, 60, 451/75, 99, 100, 101, 102

[56] References Cited

U.S. PATENT DOCUMENTS

| | | | |
|---|---|---|---|
| 2,443,148 | 6/1948 | Rucki | 451/100 |
| 3,089,285 | 5/1963 | Moore | 451/101 |
| 3,675,374 | 7/1972 | Wilder | 451/100 |
| 3,768,210 | 10/1973 | Johnson et al. | 451/101 |
| 4,976,073 | 12/1990 | Klaus-Ulfert | 451/99 |
| 5,081,799 | 1/1992 | Kirschner et al. | 51/410 |
| 5,083,402 | 1/1992 | Kirschner et al. | 51/319 |
| 5,366,560 | 11/1994 | Rubey, III et al. | 134/7 |

FOREIGN PATENT DOCUMENTS

| | | | |
|---|---|---|---|
| 333994 | 8/1936 | Italy | 451/101 |

OTHER PUBLICATIONS

Upgraded Utility Vac-Blaster Brochure, Vacublast International, Custom Metal Fabricators, Inc. Herinton, Kans.

Accustrip System Brochure, Schmidt Manufacturing Incorporated, Fresno, Tex., 1991.

*Primary Examiner*—Maurina T. Rachuba

*Attorney, Agent, or Firm*—Renner, Kenner, Greive, Bobak, Taylor & Weber

[57] ABSTRACT

A blasting apparatus, for removing coatings and contaminants on a surface by feeding a controlled volume of an abrasive medium into a compressed air stream, includes a vessel for holding the abrasive medium and an aerated-type feed valve assembly, operatively connected to the vessel, for controlling and metering an effective amount of abrasive medium into the compressed air stream, the feed valve assembly having a shaft tube having an inside diameter of at least $1\frac{1}{4}$ inches. The blasting apparatus also includes air stream hoses or manifold pipes for conveying the compressed air stream to the feed valve assembly from a source of compressed air. In addition, a blast hose is included for blasting the abrasive medium in the compressed air stream at the surface from which the coatings or contaminants are to be removed. The preferably four-wheeled blasting apparatus may also be provided with a single air pressure regulator for applying pressure equally to a pressure vessel and the air stream hose, and may employ a dump valve assembly which requires only minimal air pressure to close.

12 Claims, 3 Drawing Sheets

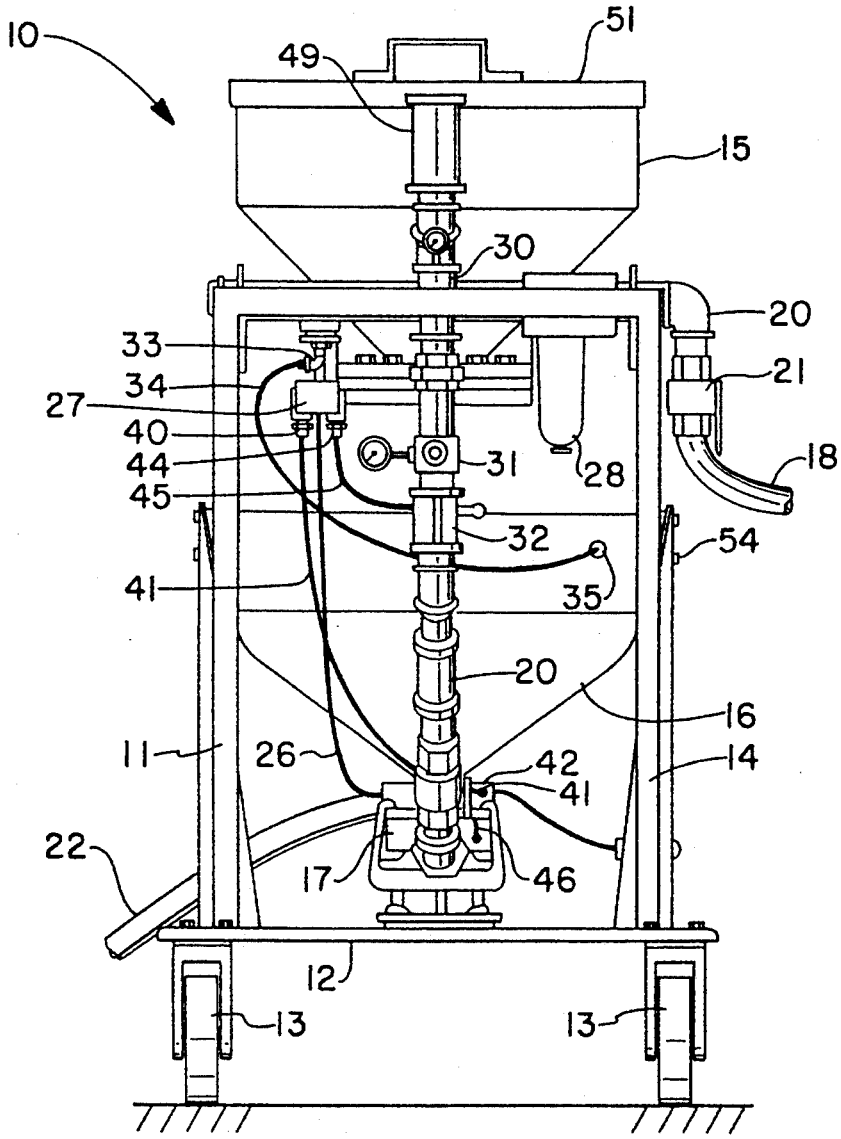
FIG.-2
FIG.-5
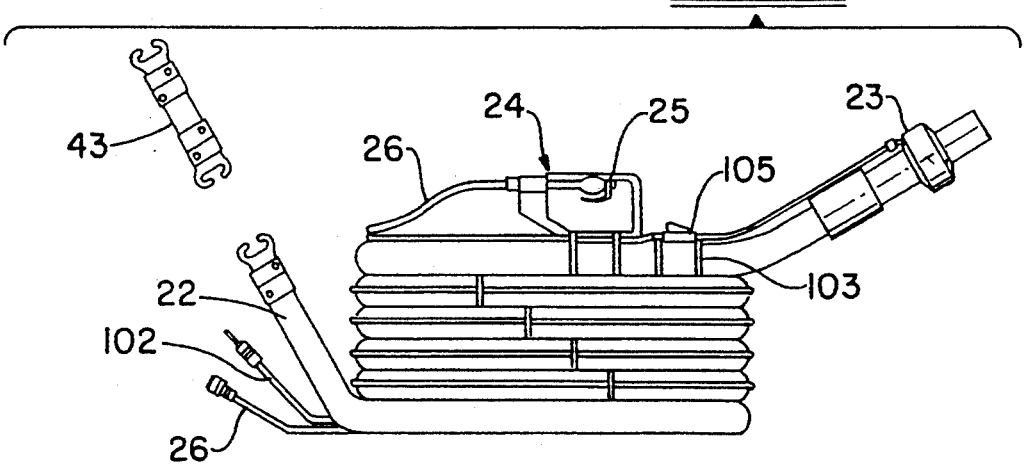

BLASTING APPARATUS, COMPONENTS THEREOF AND RELATED METHODS FOR USE THEREOF

TECHNICAL FIELD

The invention herein resides in the art of blasting equipment designed to clean, strip or otherwise remove coatings and contaminants from a variety of components and surfaces. More particularly, the invention relates to a blasting apparatus suitable for removing coatings and contaminants from substrates without effecting the surface thereof. This is accomplished by feeding a controlled volume of media into a high velocity compressed air stream and propelling the media directly at the surface to be cleaned or stripped. Specifically, the invention relates to a four-wheeled blasting apparatus provided with a single air pressure regulator for applying pressure equally to a pressure vessel and the air stream hose, and employing a dump valve assembly which requires only minimal air pressure to close and an aerated-type, fixed orifice, feed valve assembly which permit the blasting apparatus to operate efficiently and effectively with many types of media.

BACKGROUND OF THE INVENTION

Conventional abrasive blasting equipment has long been used in various industries to remove coatings such as paint or to clean grease, dirt and the like from the surfaces of a variety of composite materials or work pieces. Such conventional blasting equipment generally includes a media hopper for loading particles of an abrasive blasting medium such as sand, a pressure vessel or blast pot to hold the particles of the abrasive blasting medium, and a feed valve for metering the amount of abrasive blasting medium to be emptied into a high velocity compressed air stream which flows through a conveying hose connected to the source of compressed air. The air stream within the conveying hose passes through the metering device to a blast hose which transports the particles of blasting medium toward the nozzle of the hose which is directed toward the work piece to be cleaned or stripped. The particles of blasting medium are accelerated and dispelled from the nozzle at such a high velocity that the coating or dirt on the work piece is removed.

However, some substrates such as aluminum, magnesium, and certain types of plastic composites may be damaged or destroyed by standard abrasive media such as sand. For instance, it is well known that conventional sandblasting equipment cannot be used to clean dirty and greasy gear drives, mechanical valves, piping, glass gauges and reservoirs thin gauge metal covers and shields or painted galvanized surfaces and the like which are typically employed in the chemical or petrochemical industry. Accordingly, less aggressive abrasives such as sodium chloride or sodium bicarbonate must be used. However, conventional abrasive blasting equipment does not have a fast, sufficient or effective means for conveying media such as sodium bicarbonate from the pressure vessel through the blast hose to the nozzle.

In particular, many metering devices or feed valves employed in conventional blasting apparatuses are aerated such that a "fluidized bed" on the inside of the pressure vessel is created which enables the media to flow like a liquid through an orifice into the compressed air stream. However, conventional feed valves are equipped with and only provide for a three-quarters of an inch ($\frac{3}{4}$") inside diameter tube for the compressed air stream to flow through. Thus, while this diameter is sufficient for some media such as sand, it is not sufficient for less aggressive blasting media such as sodium bicarbonate. Specifically, when sodium bicarbonate media is used as the blasting media, a three-quarters of an inch inside diameter tube at the feed valve requires the operator to use a hose nozzle having only one-quarter inch ($\frac{1}{4}$") inside diameter because the blasting media must be delivered to the air stream from the pressure vessel at a rate complementary to the rate at which the air is flowing. Thus, a small diameter tube at the feed valve does not permit the nozzle to spray the abrasive blasting media at as fast a rate in cubic feet per minute (CFM) as a larger diameter tube or shaft. Moreover, such a small nozzle can clean or strip only a small area on a substrate at any one time. In most instances using sodium bicarbonate, it is much more desirable to use up to a one-half inch ($\frac{1}{2}$") nozzle. In order to do this, however, a one and one-quarter inch ($1\frac{1}{4}$") inside diameter air hose and feed tube through the feed valve assembly are required to accommodate the increased CFM requirement.

It is important to note at this point that due to the structure of the body casing of the feed valve assembly and the manner in which the feed valve is fabricated, a larger diameter feed tube cannot be employed with a conventional feed valve assembly. Significantly, a conventional aerated-type feed valve includes a hollow body casing having a hollow feed tube glued within the hollow shaft portion of the body casing through which compressed air may flow. A fixed orifice or feed stem may be threadably received by the body casing vertical to the hollow shaft portion such that the orifice communicates with the hollow feed tube. That is, the orifice has a centrally disposed bore therethrough which is in alignment with a bore disposed through the feed tube so that the blasting media may be received through the bore in the orifice and the feed tube and enter into the compressed air stream. At one end of the shaft portion of the body casing, a coupling for attaching the blast hose conveying the media and air stream to the nozzle may be attached by threadably receiving the shaft portion of the body casing, not the feed tube itself. Because of this, the body casing cannot, and until now, has not been made larger.

Other types of blasting apparatuses are capable of using sodium bicarbonate with larger nozzles. However, these apparatuses do not use aerated-type feed valves and are not very useful with more aggressive blasting media such as sand. For example, Kirschner et al. U.S. Pat. Nos. 5,081,799 and 5,083,402 both relate to industrial pressure blasting apparatuses which have been modified to allow a controlled pressure on the blast pot or pressure vessel that is greater than the pressure on the air stream line. Accordingly, these patents use at least two regulators, and the pressure in the blast pot or pressure vessel essentially forces the sodium bicarbonate or other relatively nonabrasive blast media into the compressed air stream. The media is not made to flow like a liquid as is essentially the case with aerated-type feed valves, but rather is vibrated vigorously to loosen any "clumps" and to force the media through an orifice disk.

In addition, when standard media fill hoppers are attached to conventional pressure vessels, yet another valve assembly is required to seal the pressure vessel during use. Accordingly, most abrasive blasting equipment includes a dump valve assembly to seal the pressure vessel during operation. However, in order to close the valve so that the blasting apparatus may function properly, at least about 30 to 40 PSI of air pressure is required. This is caused by the fact that the air used to operate this valve is required to lift a weighted down dump valve ball in order to seal the pressure vessel. This does not allow conventional blasting equipment to operate at lower blast pressures of between about 5 and 10 PSI.

Thus, the need exists for a blasting apparatus which includes an aerated-type feed valve assembly which has a large enough compressed air stream feed tube or shaft to permit the operator to use up to a one-half inch (½") nozzle with all types of abrasive blasting media including sodium bicarbonate and a dump valve assembly which requires only minimal air pressure to close the dump valve and seal the pressure vessel, thereby allowing the apparatus to function properly at low pressure.

SUMMARY OF INVENTION

In light of the foregoing, it is a first aspect of the present invention to provide a blasting apparatus useful with all types of abrasive blasting media.

It is another aspect of the present invention to provide a blasting apparatus including an aerated-type feed valve assembly having a compressed air stream shaft or tube having an inside diameter of at least one and one-quarter inches (1¼") to permit the operator of the blasting apparatus to use a nozzle having a diameter of up to one-half inch (½") with all types of abrasive blasting media.

It is yet another aspect of the present invention to provide a blasting apparatus including a dump valve assembly capable of sealing the pressure vessel with only minimal air pressure to permit blasting at low pressures of about 5 to 10 PSI.

It is still another aspect to provide a method for removing coatings and contaminants from various surfaces using the blasting apparatus of the present invention.

The foregoing and other aspects of the invention which will become apparent as the detailed description proceeds are achieved by a blasting apparatus for removing coating and contaminants from surfaces by feeding a controlled volume of an abrasive medium into a compressed air stream, the blasting apparatus including vessel means for holding the abrasive medium; an aerated-type feed valve assembly, operatively connected to the vessel means, for controlling and metering an effective amount of abrasive medium into the compressed air stream, the feed valve assembly having an inside shaft tube diameter of at least 1¼ inches; means operatively connected to said feed valve assembly for conveying the compressed air stream to the feed valve assembly; and hose means for blasting the abrasive medium in the compressed air stream at the surface from which any of the coatings or contaminants are to be removed.

Other aspects of the invention which will become apparent herein are achieved by an aerated-type feed valve assembly, in combination with a pressure vessel means for holding particles of abrasive media and hose means for transporting a stream of compressed air, the aerated-type feed valve assembly attached to the vessel means including means for providing aeration to the vessel means; means to controllably feed the particles of abrasive media into the stream of compressed air; a casing having a defined hollow shaft portion; hollow tube means having open ends and being removably received within the hollow shaft portion and carrying the stream of air through the feed valve assembly, the tube means having an inside diameter of at least 1¼ inches; and means to connect one end of the hollow tube means to the hose means.

Still other aspects of the invention which will become apparent herein are achieved by a method for removing coatings and contaminants from substrates without affecting the surfaces thereof by use of a blasting apparatus including the steps of: filling a vessel of the blasting apparatus with an abrasive medium; turning on a source of compressed air operatively connected to the blasting apparatus; actuating a control system on a blast hose of the blasting apparatus, thereby opening a stream of compressed air into the vessel and through the blasting apparatus, the pressure of the stream of compressed air and the pressure in the vessel of the blasting apparatus being regulated equally by a single air pressure regulator; and feeding and metering an effective amount of the abrasive medium into the stream of compressed air at a feed valve assembly of the blasting apparatus, the feed valve assembly having a 1¼ inch diameter shaft tube, so as to accelerate and propel the abrasive medium directly at the surface of the substrate to be cleaned or stripped.

BRIEF DESCRIPTION OF THE DRAWINGS

FIG. 2 is a rear elevational view of the blasting apparatus of FIG. 1.

FIG. 5 is a side elevational view of a blast hose assembly according to the concepts of the present invention.

PREFERRED EMBODIMENT FOR CARRYING OUT THE INVENTION

Figure 1:
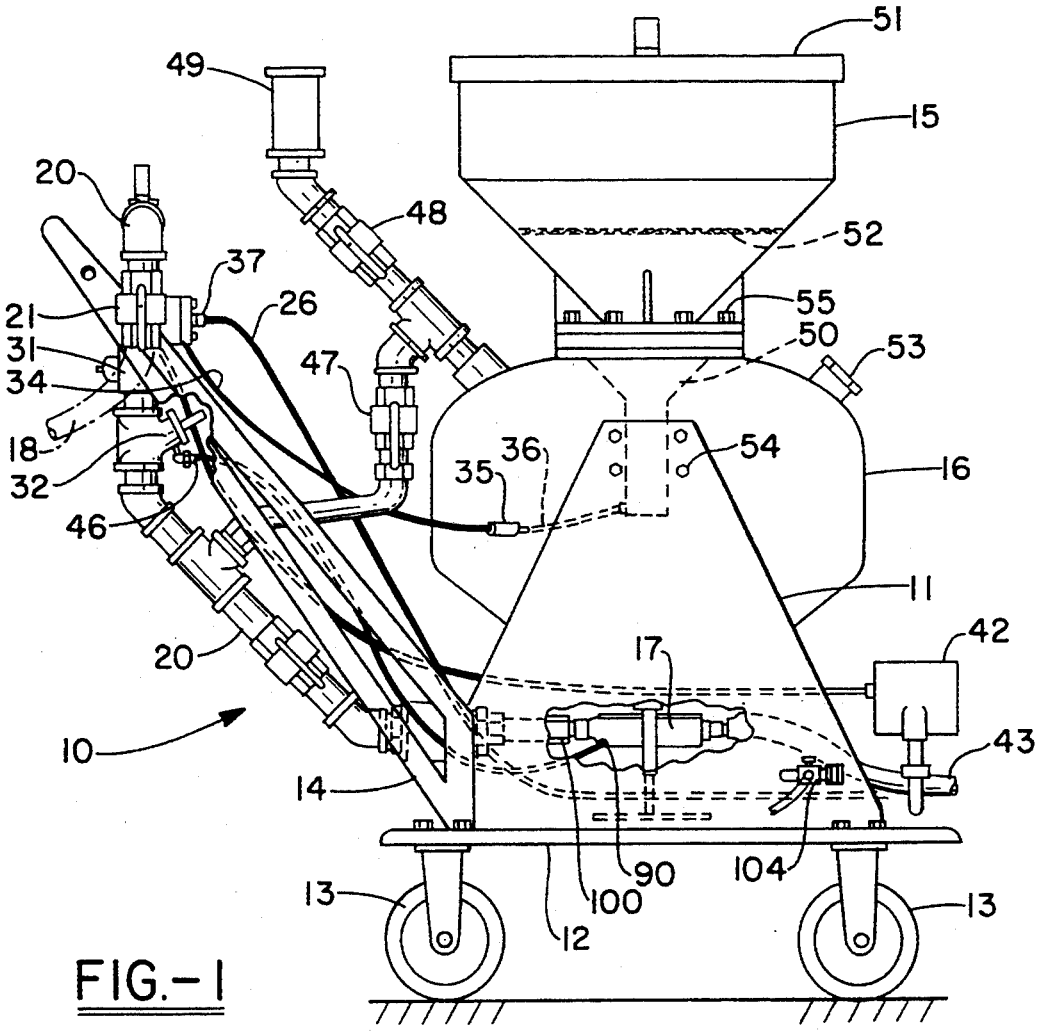
FIG. 1 is a side elevational view of a blasting apparatus embodying the concepts of the present invention.

One representative form of the blasting apparatus embodying the concepts of the present invention is generally indicated by the numeral 10 in FIGS. 1 and 2 of the accompanying drawings. Such a blasting apparatus 10 is used to remove coatings and contaminants from substrates without affecting the surfaces thereof by feeding a controlled volume of an abrasive media into a high velocity compressed air stream so as to accelerate and propel the abrasive media directly at the surface of the substrate to be cleaned or stripped.

The blasting apparatus 10 of the present invention may use any type of abrasive medium known in the art but is particularly suited for use with sodium bicarbonate. This medium is preferably non-toxic, non-hazardous, biodegradable, and water soluble, thereby eliminating the need for hazardous solvents and minimizing many problems associated with waste clean-up. The sodium bicarbonate medium is also preferably free of silicate dusts and toxic fumes, and is preferably recognized as an environmentally safe material by the Food and Drug Administration. At least one such abrasive medium is presently available from Friess Equipment of Akron, Ohio, under the trade name "SOBI" Blast Media. It will be understood, however, that other abrasive media including but not necessarily limited to sand, glass beads, aluminum oxide, sodium chloride, corn cob, coal slag, plastics, and the like, all of which are commercially available, may also be used in the blasting apparatus 10 as abrasive media.

The representative blasting apparatus 10 depicted in FIGS. 1 and 2 is shown generally attached to two upstanding supportive side panels 11 which are operatively secured to a support base 12. The base 12 preferably has four individual wheel assemblies 13 attached thereto so as to mobilize the blasting apparatus 10 as may be required. A handle 14 preferably extends upwardly at an angle at the rear of the blasting apparatus 10 from the base 12 and/or the side panels 11 to maneuver the blasting apparatus 10 into areas for use as may be required.

The blasting apparatus 10 itself generally includes a media fill hopper 15 preferably located on top of a pressure vessel 16 which is connected to a unique feed valve assembly 17 employed to control and meter an effective amount of an abrasive blasting media into a high velocity compressed air stream which flows from a source of compressed air (not shown) through a conveying hose 18 (FIG. 2) connected to the piping manifold 20 of the blasting apparatus 10 at a shut-off coupling 21. The air stream passes through the piping manifold 20 of the blasting apparatus 10 as more particularly detailed hereinbelow until it passes through the feed valve assembly 17. From there, the combined air and media stream is propelled by air pressure through a blast hose 22 (FIG. 5) having a nozzle 23 at its distal end which expels the media directly at the surface to be stripped or cleaned.

As best shown in FIG. 5, the air pressure employed in the blasting apparatus 10 is controlled by a single line, bleed-type, control system 24 known as a Deadman Blast Control System which includes a control switch 25 mounted near the nozzle 23 of the blast hose 22, and a connection hose 26 which connects the control switch 25 to a four-way diaphragm valve 27 located on the piping manifold 20 as shown in FIG. 2. The control switch 25 is a normally open valve when not in use such that, upon turning on the source of compressed air, the air "bleeds off" from the control system 24 and does not pressurized the air stream line or the pressure vessel 16.

The air does flow through at least a part of the piping manifold 20 however. As best shown in FIGS. 1 and 2, air enters the piping manifold 20 from conveying hose 18 at shut-off coupling 21 and passes through a filter 28 until it reaches a T-coupler 30 at which point the air either travels down through a single air pressure regulator 31 to a normally closed diaphragm 32 when the blasting apparatus 10 is not in operation, or continues along the piping manifold 20 to the four-way diaphragm valve 27. Accordingly, most of the air enters the diaphragm valve 27 where it is initially divided to flow through a first valve 33 connected via a hose 34 to a coupler fitting 35 located of the side of the pressure vessel 16 which is connected via a second hose 36 to a dump valve assembly 50 schematically shown in phantom in FIG. 1 and described with respect to FIG. 4 hereinbelow, and to flow through a second valve 37 connected via connection hose 26 to the blast control system 24 where it is bled from the blasting apparatus 10, and to flow through a third valve 40 connected via a hose 41 to a pinch valve assembly 42 employed to open and close a pinch hose 43 connecting the feed valve assembly 17 to the blast hose 22 as detailed hereinbelow.

When the control system 24 is actuated, the control switch 25 is closed and creates an air pressure build-up in the connection hose 26 which, in turn, actuates the four-way diaphragm valve 27 such that air no longer travels through the connection hose 26 leading to the control switch 25 or through the hose 41 connected to the pinch valve assembly 42 whereby releasing and opening the pinch hose 43. Instead, air travels through a fourth valve 44 and a hose 45 connecting the diaphragm valve 27 to the normally closed diaphragm 32 which is caused to open, thereby allowing the compressed air stream which had been blocked to pass freely through the regulator 31 and further along the piping manifold 20. That is, the air stream is then divided to apply pressure into the pressure vessel 16 and to propel the air stream through the piping manifold 20 to the feed valve assembly 17. It is noted that the air pressure employed in the blasting apparatus 10 is regulated by the single air pressure regulator 31 which supplies equal pressure to the pressure vessel 16 and to the rest of the piping manifold 20. As the air pressure is increased by the regulator 31, air pressure within the pressure vessel 16 and through the feed valve assembly 17 are proportionally increased. Air also flows through a hose 46 located on the diaphragm directly to the feed valve assembly 17 in order to provide the necessary aeration thereto as detailed hereinbelow.

In addition, it is noted that the apparatus 10 may include a choke valve 47, an exhaust valve 48 and a muffler 49 as is well known in the art. These components of the apparatus 10 are not pertinent to the novelty of the present invention, however.

With respect to the major components of the blasting apparatus 10, any media fill hopper 15 known in the art may be used with the present invention and is preferably conical in shape to facilitate quick and easy loading of the abrasive blast media into the pressure vessel 16. The media fill hopper 15 preferably includes a cover 51 removable therefrom and/or a sealed screen 52 shown in phantom in FIG. 1 and located within the fill hopper 15 to protect the apparatus from the influx of any debris or foreign materials which could damage the blasting apparatus 10 or substantially impair its effective operation. The sealed screen 52 is also used to entrap any large particles and to break up any "clumping" media which may exist prior to the blasting media entering the pressure vessel 16. Importantly, the media must be added to the pressure vessel 16 prior to turning on the source of compressed air.

The pressure vessel 16 of the present invention is constructed in accordance with ASME codes for unfired pressure vessels and should be approved for working pressures up to about 125 PSIG. The pressure vessel 16 preferably has a capacity of between about 1.5 and 5 cubic foot, although it should be understood that larger or smaller capacity vessels can be used without departing from the scope of the present invention. At least one sight glass 53 may be integrally formed with and made a part of the pressure vessel 16. The sight glass 53 is employed to inspect the inside of the pressure vessel 16 and to determine abrasive media levels which enter from the hopper 15. The sight glass 53 may also be used during maintenance and "trouble-shooting" procedures.

At this point, it is also noted that the supportive side panels 11 are securely attached to the pressure vessel 16 such that the blasting apparatus 10 is generally supported on the mobile base 12 in this manner. In the preferred embodiment shown in FIGS. 1 and 2, bolts 54 secure the side panels 11 to the pressure vessel 16.

The media fill hopper 15 is generally operatively attached to the pressure vessel 16 such as by bolts 55. Separating the media fill hopper 15 and pressure vessel 16 is an air-operated, diaphragm-type dump valve assembly 50 used to seal the pressure vessel 15 during operation of the blasting apparatus 10. Notably, the dump valve assembly 50 requires only about 5 PSI to effectively seal the pressure vessel 16. This is significantly less than the 30 to 40 PSI of air pressure required by conventional dump valve assemblies. Importantly, this lower pressure requirement for the dump valve assembly 50 enables the entire system to operate at lower blasting pressures than would otherwise be employed by conventional blasting equipment.

Figure 4:
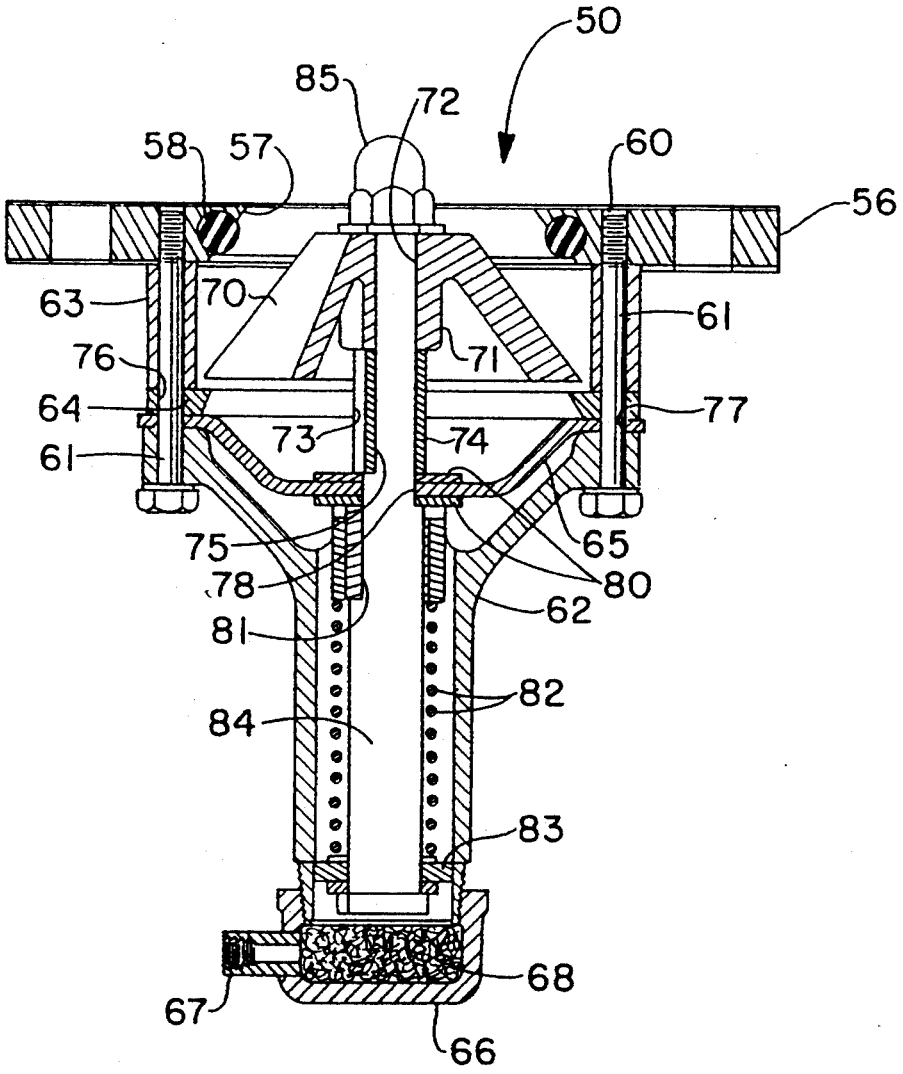
FIG. 4 is a sectional view of a dump valve assembly according to the concepts of the present invention.

More particularly, with respect to FIG. 4, the dump valve assembly 50 includes a preferably circular transverse seal plate 56 securely fastened between the fill hopper 15 and the pressure vessel 16 and having a generally circular aperture 57 disposed radially centrally thereof. A rubber gasket 58 may operatively engage the seal plate 56 in the aperture 57 and helps to more particularly define the aperture 57. A plurality of smaller holes 60 penetrates the seal plate 56 around the aperture 57, and each hole 60 receives a bolt 61 which securely fastens the outer casing 62 of the dump valve assembly 50 into place within the pressure vessel 16. The casing 62 and seal plate 56 are separated at each bolt 61 by a spacer 63 and the spacer plate 64 and diaphragm disk 65 as explained hereinbelow. A removable secured cap 66 having a fitting 67 for the receipt of air through hose 36 is received at the lower end of the casing 62. A filtering material 68 is preferably provided within the cap 66 to properly filter the incoming air.

Above the casing 62 but beneath the seal plate 56 is a frustoconical valve cone 70 having a radially centrally disposed pedestal 71 penetrated by a bore 72. The valve cone 70 operatively engages the rubber gasket 58 and seal plate 56 so as to properly close the aperture 57 and seal the pressure vessel 16 when in operation. Just below the valve cone 70 is the spacer plate 64 mentioned above having a slightly larger bore 73 disposed radially centrally thereof. As such, a sleeve 74 having a bore 75 substantially similar in size to and aligned with the bore 72 in valve cone 70 is slidably received therethrough. The sleeve 74 engages the pedestal 71 of the valve cone 70. The circumferential perimeter of the spacer plate 64 includes a plurality of holes 76 through which bolts 61 are received as noted hereinabove. Just below spacer plate 64 and sleeve 74 is positioned the arcuate, flexible diaphragm disk 65 which also has a plurality of holes 77 around its periphery which receive the bolts 61 as detailed hereinabove. The center of the diaphragm disk 65 also has a bore 78 penetrating therethrough which is also aligned with the bores in the sleeve 74 and the valve cone 70. The inner circumference of the diaphragm disk 65 is held by washers 80 which engage the sleeve 74 above and a bushing 81 below. The bushing 81 is also hollow and aligned with the other bores. A spring 82 engages the lower end of the bushing 81 and terminates at a retaining washer 83 which engages the head of a bolt shaft 84. The bolt shaft 84 extends axially through the centrally disposed bores of the various components of the dump valve assembly 50 and terminates at its other end with a nut 85 which keeps each of the components in axial alignment.

Thus, in operation, it should be clear that the dump valve assembly 50 of the present invention essentially includes a plurality of components positioned in axial alignment on a bolt shaft 84 such that as air enters the dump valve assembly 50 at fitting 67, the air pressure forces the bolt shaft 84 and each of the components aligned thereon toward the aperture 57 defined by a seal plate 56 and rubber gasket 58 at the top of the dump valve assembly 50. However, because the sleeve 74 is slidably received through spacer plate 64, the spacer plate 64 does not move. Likewise, neither does the periphery of the diaphragm disk 65. Only the downwardly curved part thereof is push upward. Accordingly, as soon as the air is shut off so as to relieve the pressure in the pressure vessel 16, the diaphragm disk 65 and spring 82 operate to reopen the aperture 57 between the media fill hopper 15 and pressure vessel 16.

Once the pressure vessel 16 has received the abrasive media and the pressure vessel is sealed by the influx of air through hoses 34 and 36, the media is then capable of being metered into the compressed air stream through the feed valve assembly 17. The preferred embodiment for the feed valve assembly 17 is a aerated-type, fixed orifice, feed valve designed to precisely control and meter the amount of sodium bicarbonate or other media that will be fed into the static flow of compressed air. As noted hereinabove, feed valve aeration is well known in the art and creates a "fluidized bed" on the inside of the pressure vessel 16 causing the media to flow like a liquid. It is this principle, coupled with the fixed orifice feed stem as detailed hereinbelow, which permits precise control of the amount of media being fed into the blast air stream.

Figure 3:
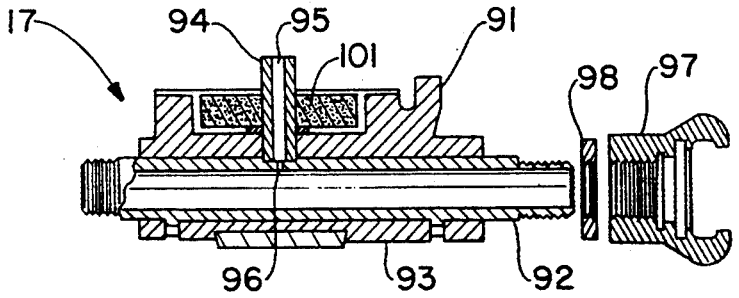
FIG. 3 is a sectional view of a feed valve assembly according to the concepts of the present invention.

The feed valve assembly 17 includes many of the features of a typical aerated-type feed valve including a fitting 90 which receives the air hose 45 as shown in FIG. 1 and which communicates between the exterior and interior of the feed valve assembly 17 to provide air to the assembly and creates the "fluidized bed" within the pressure vessel 16. As more particularly shown in FIG. 3, the feed valve assembly 17 of the present invention includes a hollow body casing 91 having a removable hollow shaft tube 92 received within the hollow shaft portion 93 of the casing through which compressed air may flow. A fixed orifice or media feed stem 94 may be threadably received by the body casing 91 vertical to the hollow shaft portion 93 such that the orifice 94 communicates with the hollow shaft tube 92. That is, the orifice 94 has a centrally disposed bore 95 therethrough which is in alignment with a bore 96 disposed through the shaft tube 92 so that the blasting media may be received through the bores in the orifice 94 and the shaft tube 92 and may enter into the compressed air stream. Unlike conventional feed valves, a coupling 97 and its complementary locking nut 98 attach the pinch hose 43 conveying the media and air stream to the pinch valve assembly 42 in FIG. 1 to one end of the shaft tube 92 rather than the body casing 91. Thus, a larger diameter shaft tube 92 may be used in the present invention. Similarly, yet another hose 100 (FIG. 1) is received by the other end of the shaft tube 92.

In operation then, it should be clear that as aeration air enters the feed valve assembly 17, it is received just below a porous disk 101 which essentially acts as a diffuser for the air which, upon passing through the disk 101, entering the pressure vessel 16 and provides the fluidized bed. The media such as sodium bicarbonate can then be fed through the fixed orifice or hollow media feed stem 94 having a suitable inside diameter which feeds the appropriate amount of media to the compressed air feed stream flowing perpendicularly thereto through the shaft tube 92. Importantly, due to the aeration, the media flows out of the pressure vessel 16 even though there is essentially the same amount of pressure flowing through the air stream shaft tube 92 as there is in the pressure vessel 16.

The shaft tube 92 is much larger in inside diameter than conventional feed valves. In fact, the shaft tube 92 has an inside diameter of at least about one and one-quarter inches (1¼"). In order to provide for this larger shaft tube 92, the body casing 91 was made shorter and larger in diameter as well.

Next, the air and media stream goes to the blast hose 22 wherein it is expelled through nozzle 23. More particularly, as shown in FIG. 5, the air and media stream passes through the pinch hose 43 which is, in turn, connected to the blast hose 22. The connection hose 26 for the control switch 25 and a water supply hose 102 run substantially parallel to the blast hose 22 and may be attached to the blast hose 22 by means such as ties 103.

A water supply port valve 104 can be seen in FIG. 1 and feeds water from a water source (not shown). The port valve 104 is connected to the water supply hose 102, shown in FIG. 5, running along the blast hose 22 and connects into the nozzle 23 such that water can be added to the air and media mixture just prior to the mixture being expelled from the nozzle 23 to suppress dust. A water shut-off valve 105 is preferably located just in front of the control switch 25 on the blast hose 23.

Thus it should be evident that the apparatus and methods of the present invention are highly effective in cleaning, stripping and decontaminating surfaces using abrasive media and a compressed stream of air. The invention is particularly suited for use with sodium bicarbonate media, but is not necessarily limited thereto. The apparatus and method of the present invention can use other control systems, valve assemblies and like components without departing from the spirit of the invention as long as the components meet the requirements detailed and claimed hereinbelow.

Based upon the foregoing disclosure, it should now be apparent that the use of the blasting apparatus described herein will carry out the aspects set forth hereinabove. It is, therefore, to be understood that any variations evident fall within the scope of the claimed invention and thus, the selection of specific component elements can be determined without departing from the spirit of the invention herein disclosed and described. In particular, the control system, dump valve assembly, and feed valve assembly described herein according to the present invention are not necessarily limited to those having the specific components stated, and other components for sealing or otherwise connecting one component to another may be included to effectively aid in the operation of the apparatus. Moreover, other means for loading the particles of media can be substituted for the fill hopper 15. Thus, the scope of the invention shall include all modifications and variations that may fall within the scope of the attached claims.

What is claimed is:

1. A blasting apparatus for removing coatings and contaminants on a surface by feeding a controlled volume of an abrasive medium into a compressed air stream, said blasting apparatus comprising:

vessel means for holding the abrasive medium;

an aerated-type feed valve assembly, operatively connected to said vessel means, for controlling and metering an effective amount of abrasive medium into the compressed air stream, said feed valve assembly having a shaft tube having an inside diameter of at least 1¼ inches;

means operatively connected to one end of said shaft tube for conveying the compressed air stream to said feed valve assembly; and hose means connected to the other end of said shaft tube for blasting the abrasive medium in the compressed air stream at the surface from which the coatings or contaminants are to be removed.

2. The blasting apparatus of claim 1, further comprising hopper means operatively attached to said vessel means for loading the abrasive medium into said vessel means.

3. The blasting apparatus of claim 2, further comprising a dump valve assembly operatively connected between said hopper means and said vessel means, wherein said dump valve assembly requires only about 5 PSI to close.

4. The blasting apparatus of claim 3, wherein said dump valve assembly includes a seal plate fastened between said hopper means and said vessel means;

an outer casing connected to said seal plate;

a spacer and a spacer plate affixed between said seal plate and said outer casing;

a movable bolt shaft aligned axially in said dump valve assembly and slidably received through said spacer plate;

a diaphragm disk, the periphery of said diaphragm disk being affixed between said casing and said spacer plate and the center of said diaphragm disk being affixed to said bolt shaft; and a valve cone operatively connected to said bolt shaft so as to operatively engage said seal plate when said bolt shaft to moved theretowards.

5. The blasting apparatus of claim 1, further comprising nozzle means connected to the blasting end of said hose means for spraying the abrasive medium, said nozzle means having an inside diameter of at least ½ inch.

6. The blasting apparatus of claim 5, further comprising control switch means mounted on said hose means near said nozzle means for operatively controlling the apparatus.

7. The blasting apparatus of claim 1, wherein said means for conveying the compressed air stream includes a single air pressure regulator and means for connecting said air regulator to said feed valve assembly and to said vessel means, said air pressure regulator being capable of applying equal air pressure to both said feed valve assembly and said vessel means.

8. The blasting apparatus of claim 7, wherein said means for conveying the compressed air stream further includes a four-way diaphragm valve in operative connection with a control switch affixed to said hose means which diaphragm valve prevents air from initially reaching said air pressure regulator, but which permits the flow of air to said air pressure regulator when it is actuated by said control switch.

9. The blasting apparatus of claim 1, further comprising a pinch valve assembly for preventing air into said hose means until actuated.

10. In combination with a pressure vessel means for holding particles of abrasive media and hose means for transporting a stream of compressed air, an aerated-type feed valve assembly attached to said vessel means comprising:

means for providing aeration to said vessel means;

means to controllably feed said particles of abrasive media into said stream of compressed air;

a casing having a defined hollow shaft portion;

hollow tube means having open ends and being removable received within said hollow shaft portion and carrying said stream of compressed air through said feed valve assembly, said tube means having an inside diameter of at least $1\frac{1}{4}$ inches; and means to connect one end of said hollow tube means to said hose means.

11. The combination of claim 10, wherein said feed valve assembly further comprises means to diffuse the air passing into said vessel means.

12. A method for removing coatings and contaminants from substrates without affecting the surfaces thereof by use of a blasting apparatus comprising the steps of:

filling a vessel of the blasting apparatus with an abrasive medium;

turning on a source of compressed air operatively connected to the blasting apparatus;

actuating a control system on a blast hose of the blasting apparatus, thereby opening a stream of compressed air into said vessel and through the blasting apparatus, the pressure of said stream of compressed air and the pressure in said vessel of the blasting apparatus being regulated equally by a single air pressure regulator; and feeding and metering an effective amount of said abrasive medium into said stream of compressed air at a feed valve assembly of the blasting apparatus, said feed valve assembly having a $1\frac{1}{4}$ inch diameter shaft tube, so as to accelerate and propel said abrasive medium directly at the surface of the substrate to be cleaned or stripped.

* * * * *